United States Patent [19]

Netsch

[11] Patent Number: 4,760,934

[45] Date of Patent: Aug. 2, 1988

[54] LIFT TAB LID WITH ACCORDIAN HINGE

[75] Inventor: Robert R. Netsch, San Francisco, Calif.

[73] Assignee: Fiberplastics, Inc., Corte Madera, Calif.

[21] Appl. No.: 861,541

[22] Filed: May 9, 1986

[51] Int. Cl.[4] ..... B65D 41/56

[52] U.S. Cl. ..... 220/269

[58] Field of Search ..... 220/269, 339, 90.2, 220/90.4, 90.6; 229/7 R

[56] References Cited

U.S. PATENT DOCUMENTS

| | | | |
|---|---|---|---|
| 3,847,300 | 11/1974 | Waters . | |
| 3,860,143 | 1/1975 | Strobe et al. . | |
| 3,977,559 | 8/1976 | Lombardi . | |
| 3,994,411 | 11/1976 | Elfelt . | |
| 4,056,210 | 11/1977 | Boyle . | |
| 4,090,660 | 5/1978 | Schram et al. | 220/90.2 X |
| 4,106,660 | 8/1978 | Boyle . | |
| 4,202,459 | 5/1980 | DeParales et al. . | |
| 4,210,272 | 7/1980 | Sequin . | |
| 4,322,015 | 3/1982 | Bailey . | |
| 4,361,250 | 11/1982 | Foster . | |
| 4,412,629 | 11/1983 | Dart et al. | 229/7 R X |
| 4,460,103 | 7/1984 | Eccles . | |
| 4,473,167 | 9/1984 | Bailey . | |
| 4,629,088 | 12/1986 | Durgin | 220/269 X |

*Primary Examiner*—Steven M. Pollard

*Attorney, Agent, or Firm*—Bertram I. Rowland; Steven F. Caserza

[57] ABSTRACT

A beverage container lid is disclosed whereby the contents of the container may be accessed via a foldable tear strip flap defined by two score lines directed radially on the lid surface, a lift tab at the peripheral sealing skirt which mates with the rim of the container, and a multi-grooved hinge that allows for easy folding of the flap into a recess in the lid surface. Each of the two side walls of the recess has a retaining lug whereby when the user desires access to the container the flap is torn free of the peripheral sealing skirt by means of the lift tab, folded back, and inserted into the recess so as to wedge the flap below the retaining lugs which secure the flap by its opposite edges.

3 Claims, 2 Drawing Sheets

LIFT TAB LID WITH ACCORDIAN HINGE

BACKGROUND OF THE INVENTION

1. Field of the Invention

A beverage container lid is disclosed which includes a foldable tear strip flap that may be fastened in the open position or closed position permitting pouring and resealing, with minimal interference with drinking from the defined opening. More particularly, the present invention relates to a beverage container lid having a tear strip flap hinged so as to allow for easy opening, fastening in the open position, and closing and is readily formed in a reproducible manner to ensure tab locking in the open position.

2. Description of the Background Art

Beverage container lids that fasten over the lip of disposable containers are well known. These lids serve various functions including: the prevention of spilling the contents of the container; the prevention of heat loss or gain; and the addition of structural stability to prevent distortion of the container's shape. In their elementary form, these lids are comprised of a flat lid surface in the shape of the container's opening and a sealing channel or skirt running the rim of the lid surface to secure the lid to the container. This basic design has the drawback that in order to gain access to the contents, the entire lid must be removed. Given the particular use situation (e.g., walking, riding in a vehicle, etc.), complete removal of the lid is neither desirable nor easily accomplished.

Various advances have been made over the basic lid which incorporate an openable tear strip flap. See for example, U.S. Pat. Nos. 3,977,559; 4,090,660; and 4,210,272. These advances allow one limited access to the container while providing for closure of the major part of the container's opening. Since no means exists with these advances to secure the tear strip flap, the individual using these lids may find that the tear strip flap interferes with the convenient and unobstructed use of the opening, particularly drinking from the opeing when straws are not available.

Another advance in lid design is represented by U.S. Pat. No. 4,106,660. Access to the container is achieved by a total separation of the tear strip flap from the remainder of the lid. With the aid of a structural cavity in the tear strip flap, the flap may be replaced to seal the opening. However, when the flap is removed there is no built-in location to store the flap until it is required for closure of the container.

A further advance in container lids was made when a means was developed to secure the tear strip flap in the open position so as not to interfere with access to the container. See, U.S. Pat. Nos. 3,847,300; 3,994,411; 4,202,459; 4,322,015; 4,460,103; and 4,473,167. In all of these improvements, the tear strip flap remains attached to the lid by a simple one fold hinge line and is secured in the open position by any of several means: (1) a pair of external frictional clamps on the flap that, when the flap is folded into the open position, engage the distal rim ('300); (2) a pull tab on the tear strip flap that is inserted into a slit for a straw orifice ('411); (3) a slot in the body of the lid that resiliently holds the sealing skirt on the rim of the tear strip flap in the open position ('459); (4) a tear strip flap held open by wedging of the flap against one or more studs projecting above the surface of the lid ('015); (5) an elevated portion of the pull flap is inserted into a complementary depressed well section ('103); and (6) a tear strip flap that is wedged into a depression in the lid's surface designed so as to accept the flap and hold it in the open position by the force exerted between the sealing skirt of the flap and the distal wall of the depression ('167).

In normal use the above-described flaps are often too stiff to easily fasten open, too loose to stay in the fixed open position, too difficult to release and easily close, unable to be repeatedly opened and revealed difficult to fabricate accurately and often, too flimsy if fabricated with anything but heavy gauge materials.

As can be seen from the above discussion, a need exists for a beverage container lid that includes a means for limited access that is easy and reliable in its operations of opening, fastening in the open position, and closing.

SUMMARY OF THE INVENTION

The subject invention comprises a lid for a beverage container having a partially accordion pleated tear strip flap which may be secured in the open position in a depression formed in the lid surface thereby allowing the user unobstructed access to the contents of the container without having to remove the entire lid.

The lid comprises a generally flat lid surface surrounded on the outer periphery by a sealing skirt which secures the lid to the rim of the container. Two radially diverging score lines define the tear strip flap. These score lines terminate at their outer ends at the peripheral sealing skirt and at their inner ends, proximal to the second of three indentations comprising a pleated, accordian-like hinge, with the tab rotating at about the center of the third pleat indentation. The multi-grooved or pleated hinge easily accommodates rotation of the tear strip flap to its secured open position. A recess is formed in the lid surface and includes a sloping wall running from the inner edge of the multi-grooved hinge line at the surface of the lid to the floor of the recess. Two side wall retaining lugs are provided, formed in the side walls of the recess proximal to the rear wall for securing the opposite sides of the tear strip flap in the open position. Such a lid design has been found to provide for highly reliable opening, fastening in the open position, and releasing for closure of the access tear strip flap.

DESCRIPTION OF THE PREFERRED EMBODIMENT

Figure 1:
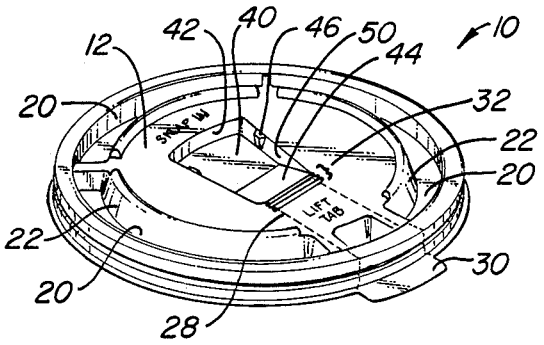
FIG. 1 is a perspective view of the preferred embodiment of the beverage container lid of the subject invention illustrating the tear strip flap in a partially opened position.
Figure 2:
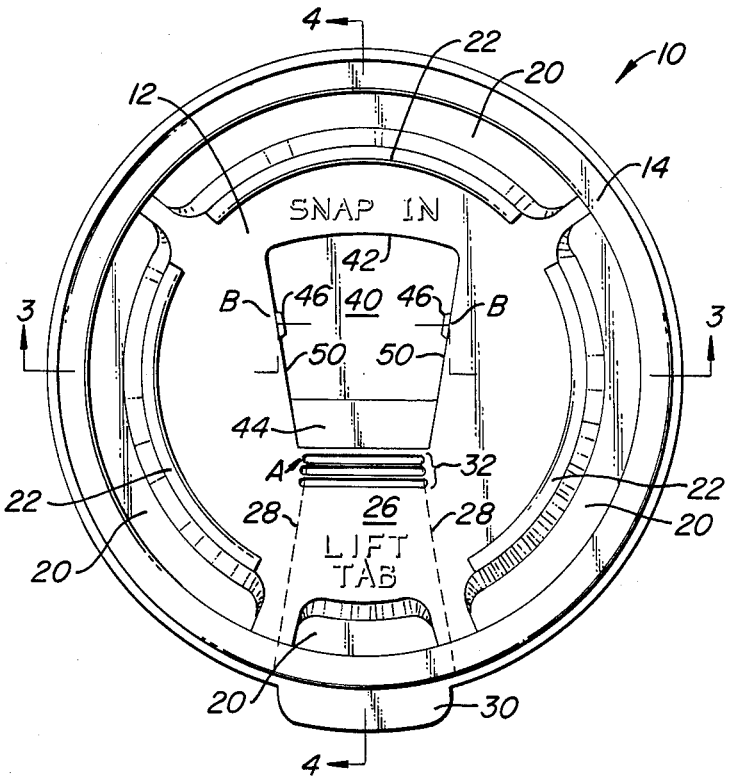
FIG. 2 is a top view of the beverage container lid of the subject invention with the tear strip flap fully closed.
Figure 3:
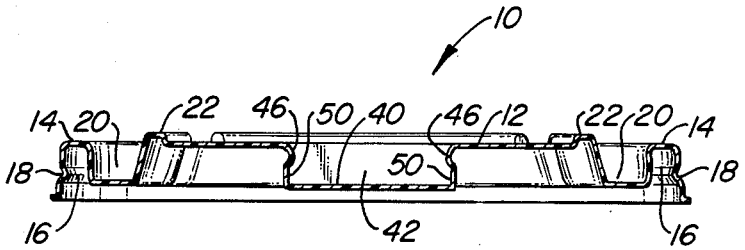
FIG. 3 is a sectional view of the beverage container lid of the subject invention taken along line 3—3 of FIG. 2.

Referring now to FIGS. 1–3, there is shown a beverage container lid 10 of the subject invention. Included in the container lid 10 is a generally flat lid surface area 12 which is circumscribed by a peripheral sealing skirt 14. The sealing skirt 14 has a generally U-shaped cross-section (FIG. 3) and defines the receiving channel 16 peripherally surrounding the lid 10 for fitting on the cup rim (not shown). The diameter of the lid 10 and the dimensions of the receiving channel 16 are selected to complement the rim dimensions of a particular beverage container, thereby allowing the lid 10 to mate with the rim of the container forming a seal. An annular indentation 18 is provided on the outer face of the sealing skirt 14 to aid in forming the seal between the lid 10 and the rim of the container.

A plurality of annular channels 20 and annular ridges 22 will normally be included in the lid 10 for structural reinforcement of the lid. The exact numbers and location of these structural elements may be varied, although the configuration depicted is preferred in the preferred embodiment.

A foldable tear strip flap 26 projects radially inward from the periphery of the container lid 10. The tab 26 is defined by a pair of score lines 28 which commence at the outer edge of the peripheral sealing skirt 14 and terminate proximal to point A (FIG. 2) in the center of the last of the three indentations comprising the pleated multi-grooved, accordian-like hinge 32. The score lines substantially penetrate the thickness of the lid 10 and are formed by conventional means after the lid 10 has been vacuum molded. The tear strip flap 26 includes a lift tab 30 at its outer radial end and terminates at the boundary between the multi-grooved hinge 32 and the upper edge of the sloping hinge wall 44. To prevent the tear strip flap 26 from opening until desired, score lines 28 do not continue on into the outer face of the peripheral sealing skirt 14. The user may open the tear strip flap 26 by pulling on the lift tab 30 which results in a tearing of the outer face of the peripheral sealing skirt 14 and an opening of the flap 26.

Figure 4:
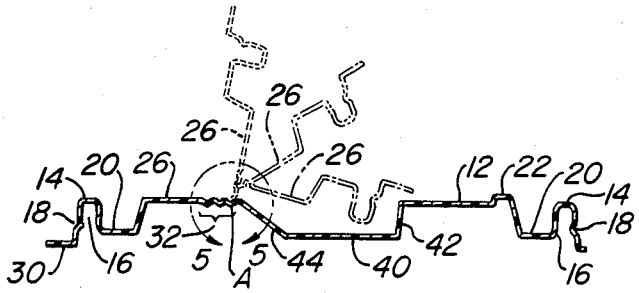
FIG. 4 is a sectional view of the beverage container lid of the subject invention taken along line 4—4 of FIG. 2, with the tear strip flap illustrated in closed, partially opened, and opened position.
Figure 5:
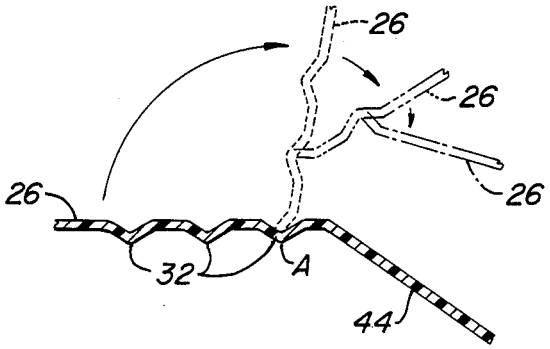
FIG. 5 is a blow-up sectional view of the multi-grooved hinge of FIG. 4, showing the jointed movement of the hinge during opening of the tear strip flap.

The lid 10 includes novel and improved means for hinging the tear strip flap 26 and for securing the flap 26 in its fully opened position (as illustrated in FIGS. 4 and 5). A recess 40 is formed near the center of the lid surface area 12. Recess 40 has dimensions selected to correspond to those of the tear strip flap 26 so that the flap 26 may be received, except for the left tab 30, almost entirely within the depression of recess 40. Recess 40 extends radially outward from the inner edge of the multi-grooved hinge 32. The opposing side walls 50 and the end wall 42 are approximately vertical while the sloping wall 44 adjacent to and extending away from the hinge angles downward from the multi-grooved hinge 32 until it terminates on the floor of recess 40 at about one-third the distance between the multi-grooved hinge 32 and the end wall 42. The depth at the end wall 42 is sufficient to receive the peripheral sealing skirt 14 portion of the tear strip flap 26 (see FIG. 4).

Tear strip flap 26 is retained in the open position by novel use of two opposing retaining lugs 46, one retaining lug 46 formed in each of the two side walls 50 (see FIGS. 1, 2, and 3). These retaining lugs 46 are located at approximately two-thirds of the distance between the multi-grooved hinge 32 and the end wall 42 of the recess 40. Further, because of the flap 26 clearance at the rear of the recess 40, the outer edge of the flap is proximal but removed from the end wall, and because the flap 26 is totally side retained and need not contact the end wall 42 for retention, the tear strip flap 26 may have a hinge point that can vary as much as ⅛ inch and still function properly. Additionally, retaining lugs 46 are formed by two undercut steel pins pressed into the aluminum mold insert instead of large machined undercuts at the rear of the recess 40 previously necessary to secure the flap. The use of only two undercut steel pins allows for easier machining of the insert since the recess 40 itself has no machined undercuts; enhanced forming and mold stripping since the undercut area is limited to the small retaining lugs 46; and increased insert life since the high wear areas (undercuts) are formed by long wearing, replaceable steel pins.

Referring now in particular to FIGS. 4 and 5, the novel multi-grooved hinge 32 will be described in detail. This major improvement over the prior art hinge configuration involves the use of a multi-grooved hinge 32. This improved hinge features three shallow (non-vertical walled) hinge grooves. The score lines 28 are made through the first two hinge grooves to near the center of the third groove (point A in FIGS. 1, 2, 4, and 5). The termination of the score lines 28 in the third groove induces the tear strip flap 26 to hinge initially in the third groove (see FIG. 5). As the flap 26 is bent further back (see FIG. 5), the third groove "goes solid" at approximately 102° rotation. At this point, the first and second grooves begin to share the deflection until the flap 26 is in its locked open position.

Several advantages exist from the use of this new multi-grooved hinge 32. First, each groove has approximately 100° of rotational capacity, therefore, the entire hinge system has approximately 300° of total rotational capacity. Since the tear strip flap 26 rotates approximately 200° to the locked position, the hinge easily accommodates this rotation and does not force the flap 26 itself to deflect. Previous hinge designs lacked the necessary rotational capacity and forced the flap to bend, causing undesirable bowing of the flap. Second, since the new three-groove hinge system has considerable excess rotational capacity, the forming and scoring processes, the tooling tolerances forming and scoring processes, and the tooling tolerances become less critical to the performance of the lid. For example, this allows the use of the same score tooling and set-up for several different sizes of lids. Third, the hinge grooves are more shallow and gently sloped, therefore, mold stripping and particularly forming are easier than for the deeper, vertical-walled single groove constructions.

Finally, for a user to open a beverage container covered by the subject invention lid 10, the user initially pulls up on the lift tab 30 which results in a tearing of the outer portion of the peripheral sealing skirt 14 between the lift tab 30 and the outer terminal ends of the score lines 28. Once the sealing skirt 14 is broken, the flap 26 will raise easily, gradually folding at the multi-grooved hinge 32, as illustrated in FIG. 4. Opened flap 26 is then easily snapped into recess 40 under the side retaining lugs 46. The retaining lugs 46 firmly hold the tear strip flap 26 until the user desires to close the container lid 10. Given the flexible nature of the multi-grooved hinge 32, the user simply pulls upward on the lift tab 30 thereby freeing the tear strip flap 26 from the recess 40. Flap 26 may be resealed over the opening by applying light pressure to the peripheral sealing skirt 14 on flap 26 back against the rim of the container.

The subject invention lids may be fabricated from any thermoplastic material which is flexible and resiliently moves to receive, lock, and release the tear strip flap. Suitable materials include, but are not limited to: polyethylene; polyvinylchloride; polypropylene; polystyrene, and the like. Relatively thin materials may be employed in the subject invention. The thickness of the material may vary and is usually 5 to 20 mils, more usually 5 to 15 mils, and preferably 5 to 12 mils.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A beverage container lid comprising:

a lid surface having a peripheral sealing skirt for attachment of the lid to the rim of a beverage container;

a foldable tear strip flap as part of the lid formed by the peripheral sealing skirt radially inward and terminating in a multi-grooved hing, wherein said multi-grooved hinge is comprised of three shallow non-vertical walled hinge grooves;

a recess formed in the lid surface and including two essentially vertical side walls extending radially outward from the multi-grooved hinge, an essentially vertical end wall opposite the multi-grooved hing, and a sloping wall extending from said hinge; and a set of opposing side wall retaining lugs removed from and proximal to said end wall for securing the sides of the flap, whereby said tear strip flap skirt portion has a non-contact relationship with said recess end wall when said tear strip flap is secured by said retaining lug in an open position.

2. A beverage container lid as in claim 1, wherein said score lines terminate essentially in the center of a hinge groove of the multi-grooved hinge closest the center of the lid surface.

3. A beverage container lid as in claim 1 wherein said retaining lugs are located at approximately two-thirds of the distance between said multi-grooved hinge and said end wall.

* * * * *